US007834868B2

(12) United States Patent
Lee

(10) Patent No.: US 7,834,868 B2
(45) Date of Patent: Nov. 16, 2010

(54) SYSTEMS FOR DISPLAYING IMAGES AND CONTROL METHODS THEREOF

(75) Inventor: Szu-Hsien Lee, Kaohsiung (TW)

(73) Assignee: TPO Displays Corp., Chu-Nan, Miao-Li County (TW)

( * ) Notice: Subject to any disclaimer, the term of this patent is extended or adjusted under 35 U.S.C. 154(b) by 915 days.

(21) Appl. No.: 11/344,931

(22) Filed: Feb. 1, 2006

(65) Prior Publication Data

US 2007/0176876 A1 Aug. 2, 2007

(51) Int. Cl.
*G09G 3/36* (2006.01)

(52) U.S. Cl. ..... 345/209; 345/96

(58) Field of Classification Search ..... 345/204, 345/92, 100, 87, 76, 692, 103, 208–209, 345/96

See application file for complete search history.

(56) References Cited

U.S. PATENT DOCUMENTS

| | | | | |
|---|---|---|---|---|
| 4,908,609 | A * | 3/1990 | Stroomer | 345/88 |
| 6,876,365 | B1 * | 4/2005 | Tsutsui et al. | 345/536 |
| 6,963,328 | B2 * | 11/2005 | Kang et al. | 345/100 |
| 7,038,652 | B2 * | 5/2006 | Kang et al. | 345/98 |
| 7,164,407 | B2 * | 1/2007 | Matsuyama | 345/98 |
| 2004/0207592 | A1 | 10/2004 | Ludden | |
| 2004/0239605 | A1 * | 12/2004 | Wang et al. | 345/96 |
| 2005/0179634 | A1 * | 8/2005 | Bu | 345/100 |
| 2006/0001630 | A1 * | 1/2006 | Chen et al. | 345/96 |
| 2006/0066555 | A1 * | 3/2006 | Miyagawa | 345/100 |
| 2006/0087488 | A1 * | 4/2006 | Ito | 345/103 |
| 2006/0158418 | A1 * | 7/2006 | Kieschnick et al. | 345/100 |

FOREIGN PATENT DOCUMENTS

| | | |
|---|---|---|
| CN | 1530723 | 9/2004 |
| JP | 11095729 | 4/1999 |

OTHER PUBLICATIONS

U.S. Appl. No. 11/199,862, filed Aug. 8, 2005.
U.S. Appl. No. 11/200,537, filed Aug. 8, 2005.
U.S. Appl. No. 11/229,881, filed Sep. 19, 2005.
US Serial No. "Unassigned"; Filed Nov. 30, 2005.
CN Office Action mailed Apr. 18, 2008.

* cited by examiner

*Primary Examiner*—Amr Awad
*Assistant Examiner*—Tony Davis
(74) *Attorney, Agent, or Firm*—Thomas, Kayden, Horstemeyer & Risley

(57) ABSTRACT

Systems for displaying images and control methods are provided. In this regard, a representative control method for a display panel comprising a first source line, a second source line, a third source line, a first gate line and a second gate line, comprises: asserting the first gate line; and sequentially providing a data signal of a first polarity from a first data driver to the first source line and the third source line, and then providing a data signal of a second polarity from the data driver to the second source line.

18 Claims, 9 Drawing Sheets

SYSTEMS FOR DISPLAYING IMAGES AND CONTROL METHODS THEREOF

BACKGROUND

The disclosure relates to the display of images, such as by using display panels.

FIG. 1 is a schematic diagram of a display device. Gate driver 10 outputs the scan signals (also referred to as scan pulses) of each of the gate lines G1, G2, . . . , Gn according to a predetermined sequence. When a scan signal is carried on one gate line, the thin film transistors (TFTs) within all display units 200 on the same row or "scan line" are turned on while the TFTs within all display units 200 on rows or other scan lines are in a state to be turned off. When a scan line is selected, data or source driver 20 outputs a video signal (gray value) to the m display units of the respective rows through source lines S1, S2, . . . , Sm according to the image data to be displayed. After gate driver 10 scans n rows continuously, the display of a single frame is completed. Thus, repeated scans of each scan line can achieve the purpose of continuously displaying the image.

Typically, a video signal, which is transferred by the source lines S1, S2, . . . , Sm, is divided into a positive video signal and a negative video signal based on the relationship with the common electrode voltage $V_{COM}$. The positive video signal indicates a signal having a voltage level higher than the voltage $V_{COM}$. On the other hand, the negative video signal indicates a signal having a voltage level lower than the voltage $V_{COM}$. When a positive video signal and a negative video signal are individually applied to the display units 200, the display effect generally is the same.

In order to prevent the liquid crystal molecules of a display unit from continuously receiving a single-polar bias voltage, which reduces the liquid crystal molecular life, a display unit respectively receives positive and negative polar video signals corresponding to odd and even frames.

The disposition of the different polar video signals in each display unit can be divided into frame inversion, column inversion, and dot inversion. In frame inversion driving mode, the polarity of the video signals are the same for all display units during the same frame, but the opposite polarity is used for all displays during adjacent frames.

FIG. 2*a* is a schematic diagram of a column inversion driving mode. The display units of the same column on the same frame use the same polarity of the video signal, but the opposite polarity of the video signal is used for display units of adjacent lines or columns. For example, when gate driver 10 asserts gate line G1, controller 25 turns on switch SW21*a* and data driver 21 provides data signal D1 of a positive voltage to source line S1. Next, controller 25 turns on switch SW21*b* and data driver 21 provides data signal D1 of a negative voltage to source line S2. Then, controller 25 turns on switch SW21*c* and data driver 21 provides data signal D1 of a positive voltage to source line S3.

When gate driver 10 asserts gate line G2, controller 25 turns on switch SW21*a* and data driver 21 provides data signal D1 of a positive voltage to source line S1. Next, controller 25 turns on switch SW21*b* and data driver 21 provides data signal D1 of a negative voltage to source line S2. Then, controller 25 turns on switch SW21*c* and data driver 21 provides data signal D1 of a positive voltage to source line S3. Note that the operation of data drivers 22-24 is similar to that of data driver 21.

In this example, the polarity of the data signal D1 provided from data driver 21 is changed twice per line. Assuming the resolution of the display panel is 240×3×320 and a frame frequency is 60 Hz, a switch frequency of data driver 21 is 38.4 KHz (60 Hz×320×2).

FIG. 2*b* is a schematic diagram of a dot inversion driving mode. In dot inversion driving mode, the polarity of the video signals used by the display units during the same frame is presented in an interlaced form.

For example, when gate driver 10 asserts gate line G1, controller 25 turns on switch SW21*a* and data driver 21 provides data signal D1 of a positive voltage to source line S1. Next, controller 25 turns on switch SW21*b* and data driver 21 provides data signal D1 of a negative voltage to source line S2. Then, controller 25 turns on switch SW21*c* and data driver 21 provides data signal D1 of a positive voltage to source line S3.

When gate driver 10 asserts gate line G2, controller 25 turns on switch SW21*a* and data driver 21 provides data signal D1 of a negative voltage to source line S1. Next, controller 25 turns on switch SW21*b* and data driver 21 provides data signal D1 of a positive voltage to source line S2. Then, controller 25 turns on switch SW21*c* and data driver 21 provides data signal D1 of a negative voltage to source line S3.

In this example, the polarity of voltage provided from data driver 21 is changed three times per line. That is, in contrast to the column inversion driving mode, the polarity of the signal D1 changes a third time for each gate line because the signal D1 changes polarity between the last source line of a respective gate line and the first source line of the next gate line, e.g., between G1-S3 and G2-S1. Assuming the resolution of the display panel is 240×3×320 and a frame frequency is 60 Hz, a switch frequency of data driver 21 is 57.6 KHz (60 Hz×320×3).

SUMMARY

Systems for displaying images and control methods are provided. In this regard, an exemplary embodiment of such a system comprises a display panel. The display panel comprises: a first data driver, a first source line, a second source line, a third source line, a first gate line and a second gate line; a first selection unit coupled to the first source line; a second selection unit coupled to the second source line; and a third selection unit coupled to the third source line. The display device is operative such that a data signal of a first polarity or a data signal of a second polarity to the first source lines or the second source line through the first selection units or the second selection unit, wherein the processing unit can sequentially turns on the first selection units such that the first source lines receive the data signal of the first polarity and then turns on the second selection unit such that the second source line receives the data signal of the second polarity.

Another exemplary embodiment of such a system comprises a control module for a display panel comprising a first and a second source lines and a first and a second gate lines. The control module comprises: a first selection unit coupled to the first source line; a second selection unit coupled to the second source line; and a processing unit operative to control the first selection unit and the second selection unit and to output a data signal of a first polarity or a data signal of a second polarity to the first source line or the second source line through the first selection unit or the second selection unit, wherein as the first gate line is asserted, the processing unit turns on the first selection unit such that the first source line receives the data signal of the first polarity and then turns on the second selection unit such that the second source line receives the data signal of the second polarity, and as the first gate line is un-asserted and the second gate line is asserted, the processing unit turns on the second selection unit such that the second source line receives the data signal of the second polarity and then turns on the first selection unit such that the first source line receives the data signal of the first polarity.

An exemplary embodiment of a control method for a display panel comprising a first source line, a second source line, a third source line, a first gate line and a second gate line, comprises: asserting the first gate line; and sequentially providing a data signal of a first polarity from a first data driver to the first source line and the third source line, and then providing a data signal of a second polarity from the data driver to the second source line.

BRIEF DESCRIPTION OF THE DRAWINGS

The invention can be more fully understood by reading the subsequent detailed description and examples with reference made to the accompanying drawings, wherein.

DETAILED DESCRIPTION

Figure 1:
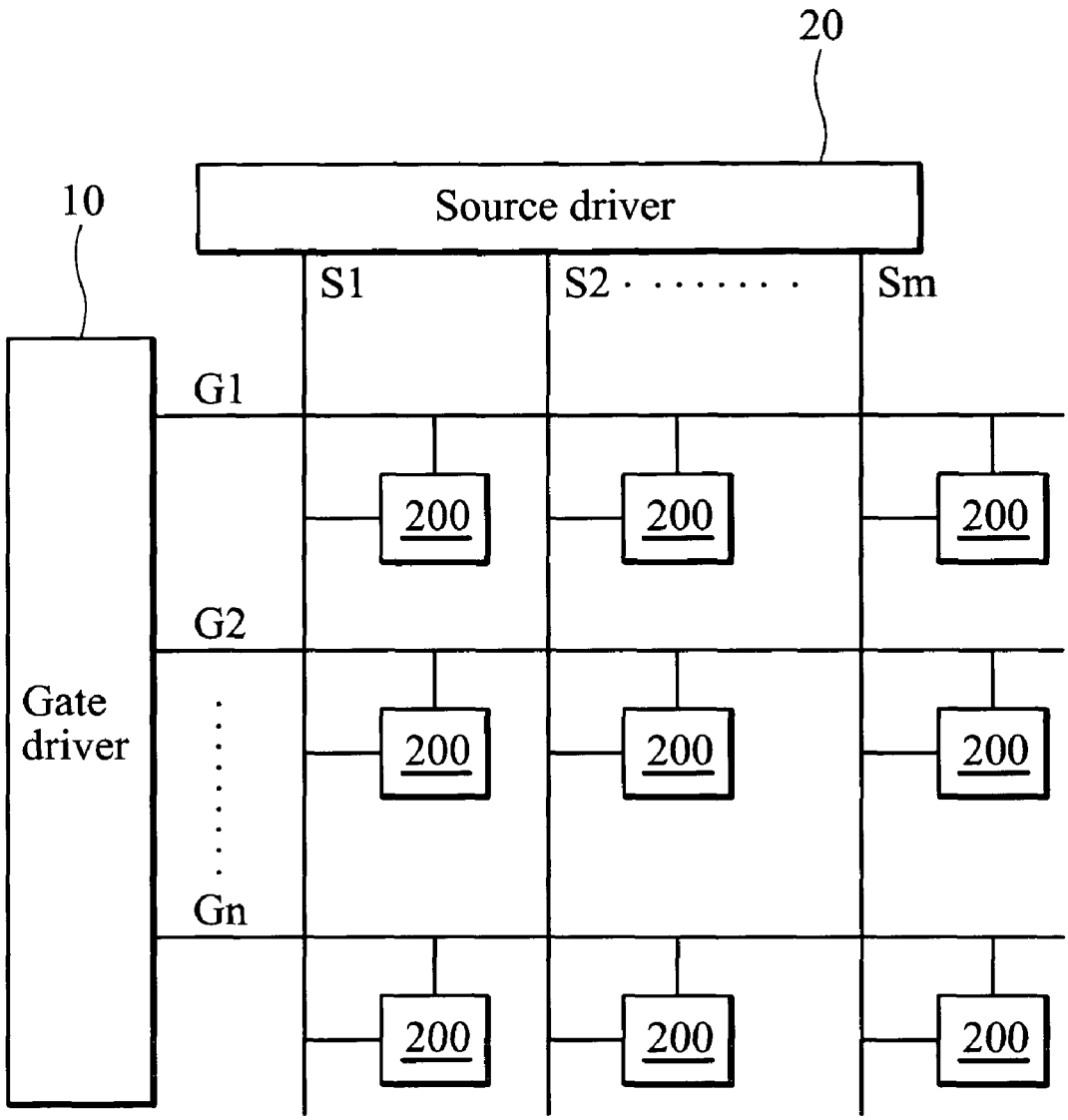
FIG. 1 is a schematic diagram of a display device.
Figure 2A:
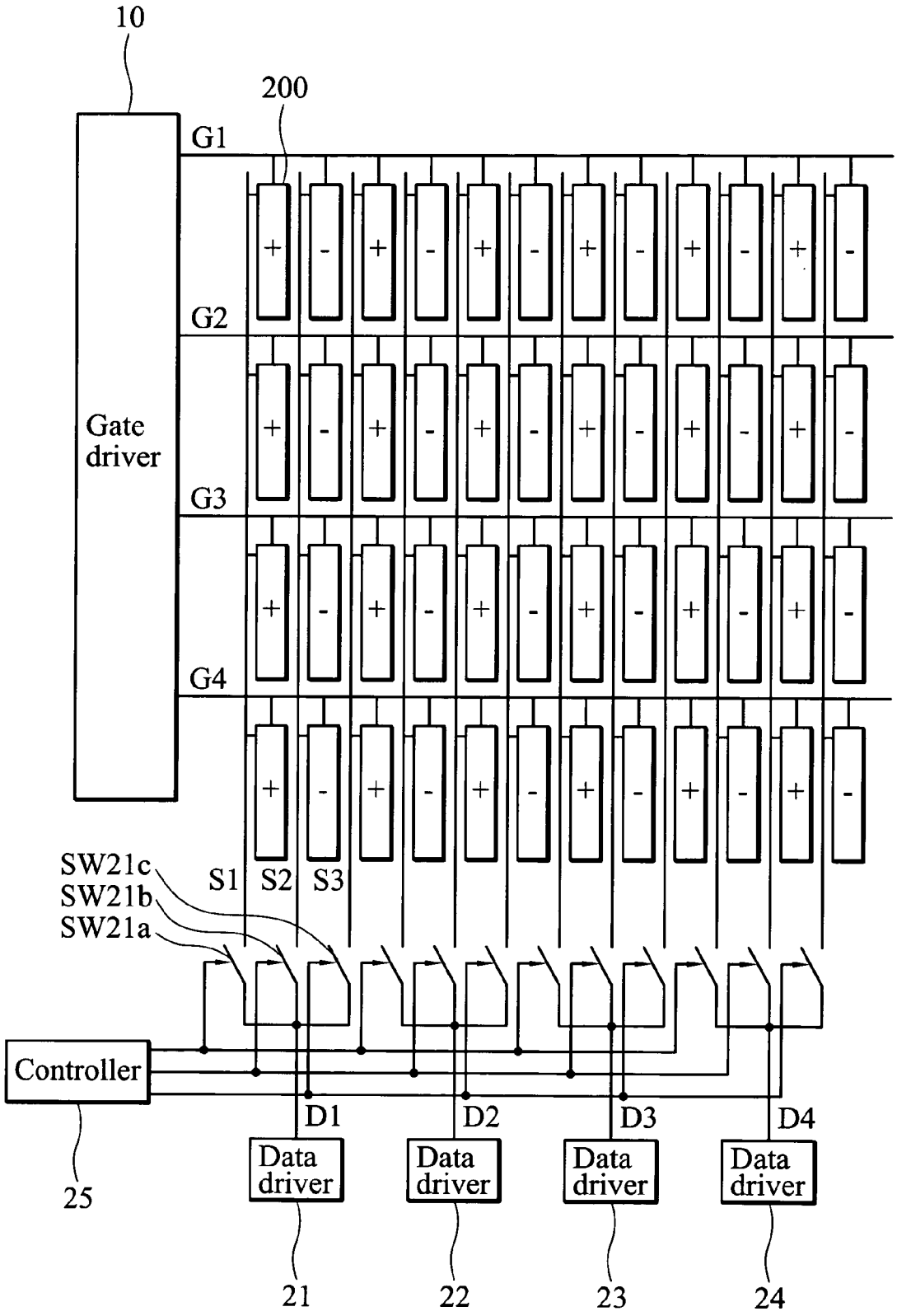
FIG. 2*a* is a schematic diagram of a column inversion driving mode.
Figure 2B:
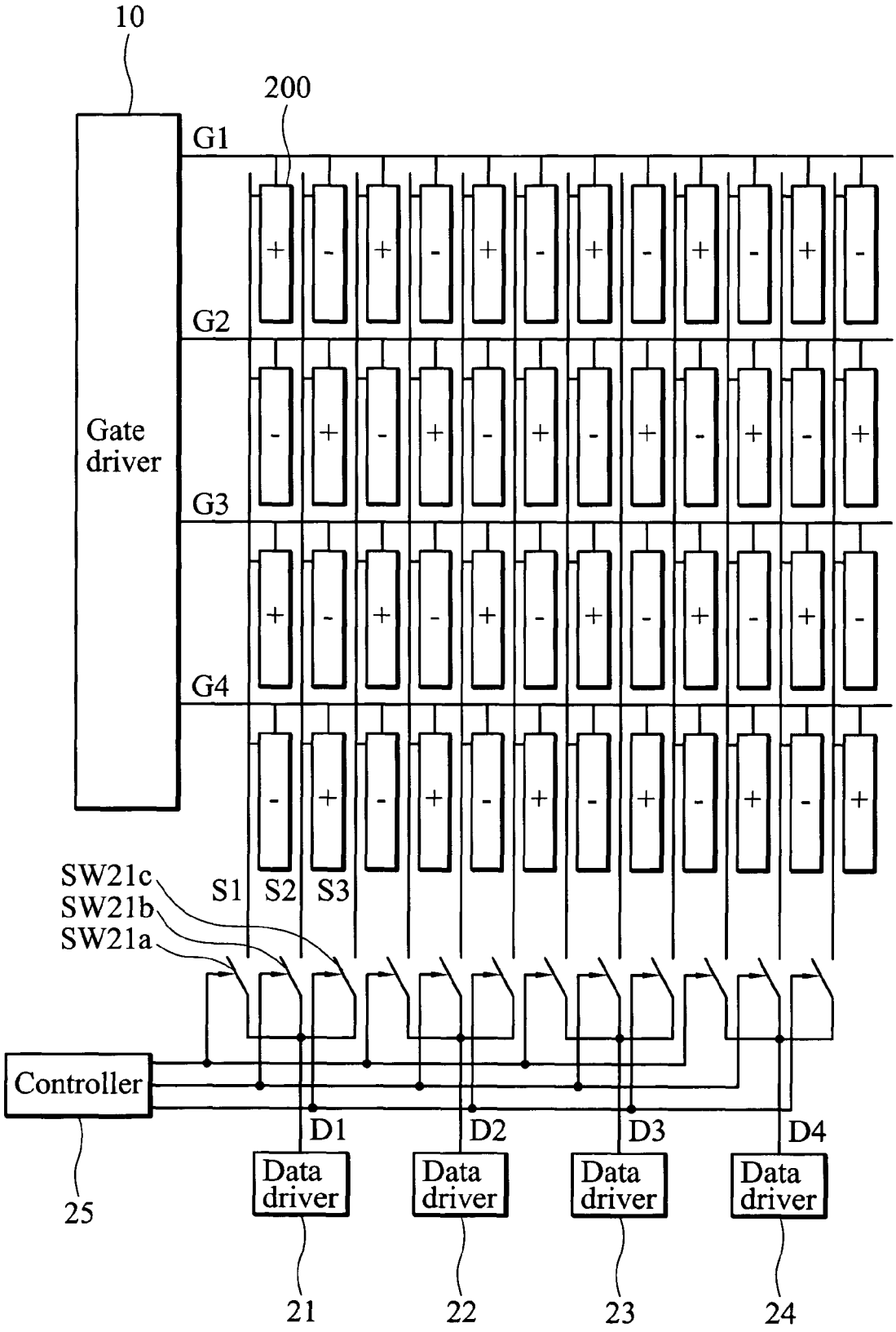
FIG. 2*b* is a schematic diagram of a dot inversion driving mode.
Figure 3A:
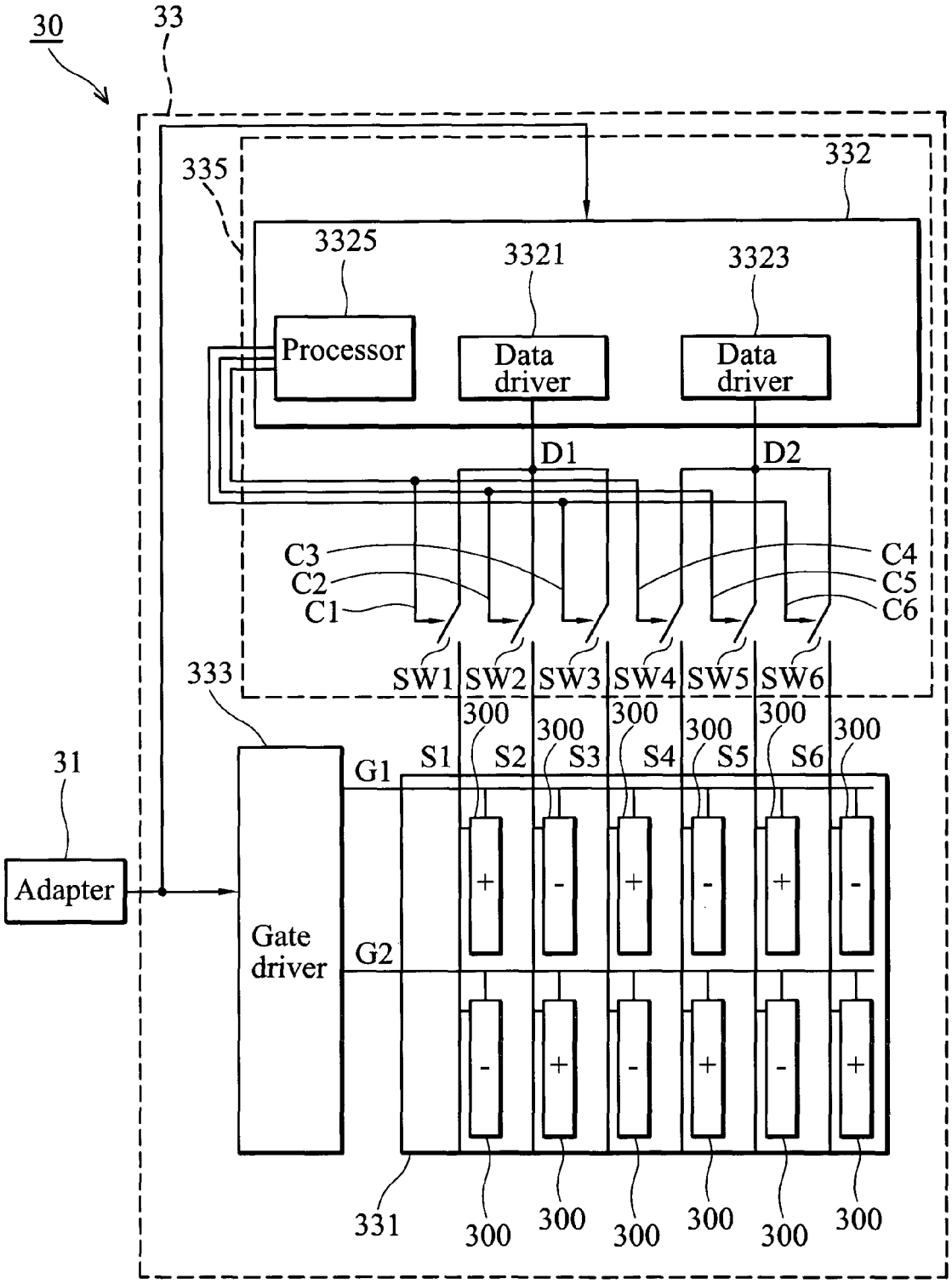
FIG. 3*a* is a schematic diagram of an exemplary embodiment of a system for displaying images.
Figure 3B:
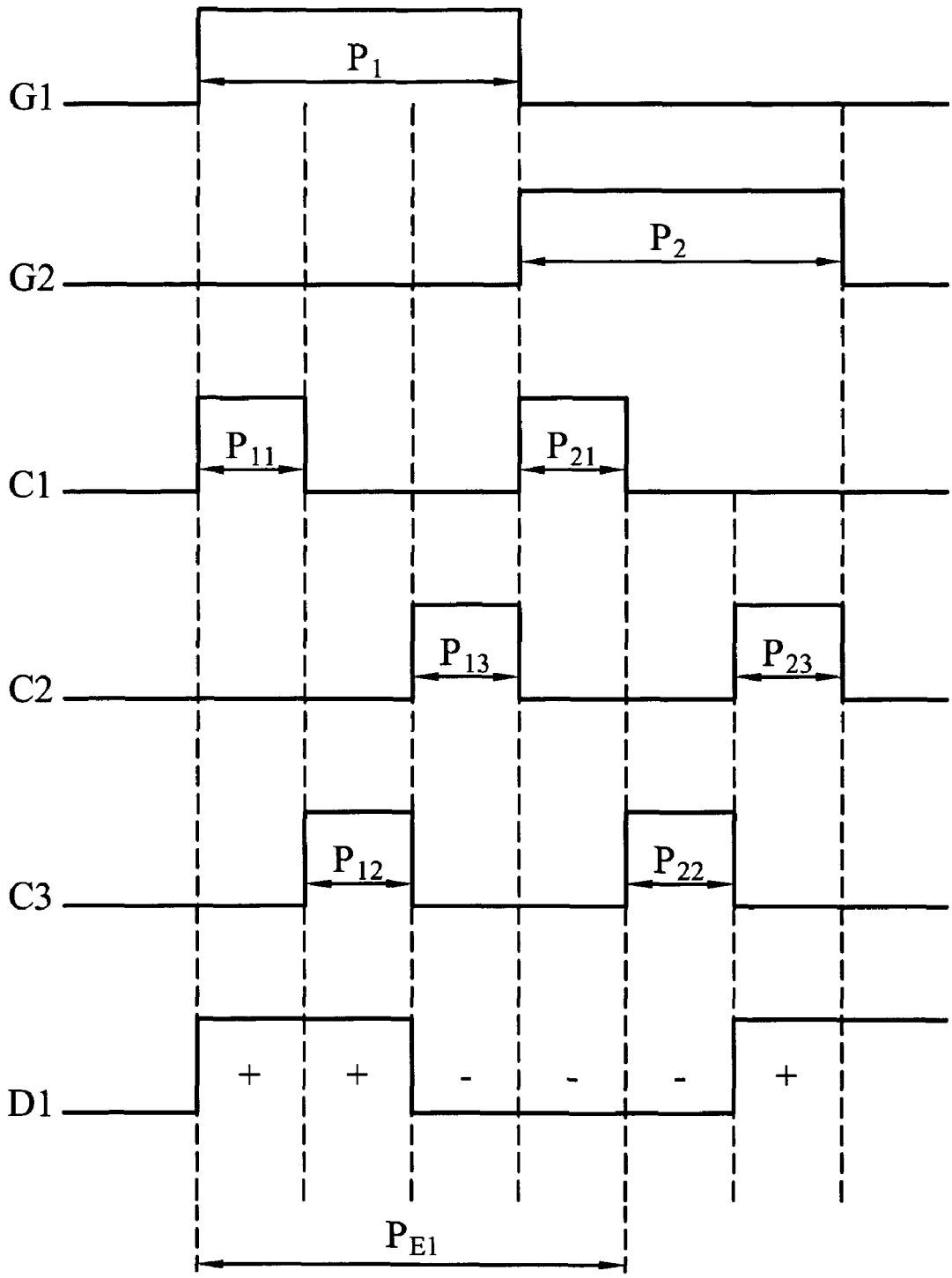
FIG. 3*b* is a timing diagram that can be used by the control module of FIG. 3*a;*
Figure 3C:
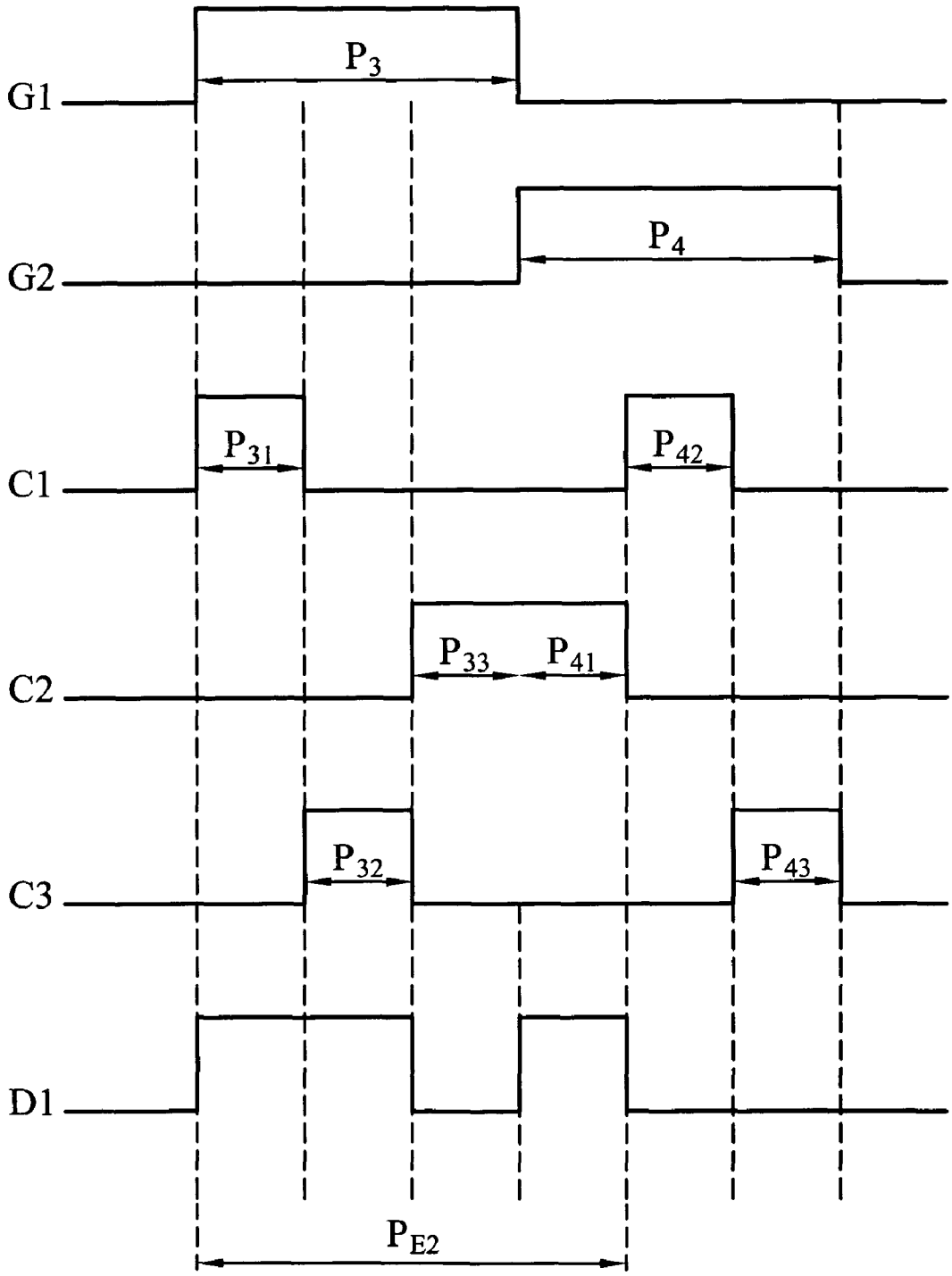
FIG. 3*c* is another timing diagram that can be used by the control module of FIG. 3*a;*

FIG. 3*a* is a schematic diagram of an exemplary embodiment of a system for displaying images. As shown in FIG. 3*c*, the system is implemented as an electronic device 30 that comprises an adapter 31 and a display device 33. Adapter 31, such as DC to DC converter, provides a driving voltage to the display device 33 for displaying images. In this embodiment, display device 33 utilizes a dot inversion driving method to display images. The display device comprises a display module 331, a gate driver 333, and a control module 335.

Display module 331 comprises a plurality of source lines and gate lines for controlling a plurality of pixel units. For clarity, only six source lines S1~S6 and two gate lines G1~G2 are shown. The source lines and gate lines are used to control the display units 300.

In particular, gate driver 333 asserts gate lines G1 and G2. When gate line G1 is asserted, display units in the first row (horizontal direction) receive a data signal from source lines S1~S6. When gate line G2 is asserted, display units in the second row (horizontal direction) receive a data signal from source lines S1~S6.

Control module 335 comprises switches SW1~SW6 and a processing unit 332. Switches SW1~SW6 are divided into first selection units and second selection units and are respectively coupled to source lines S1~S6. Processing unit 332 provides a data signal of a first polarity or a data signal of a second polarity to the first or the second selection units.

In this embodiment, processing unit 322 comprises data drivers 3321, 3323, and processor 3325. In other embodiments, the processing unit only utilizes one controller to control all of the switches. Since the operations of data drivers 3321 and 3323 are the same, data driver 3321 is given as an example.

Data driver 3321 provides data signal D1 to switches SW1~SW3. Since data driver 3321 provides the data signals of the first polarity to source lines S1 and S3 through switches SW1 and SW3, switches SW1 and SW3 are first selection units and source lines S1 and S3 are first source lines. Since data driver 3321 provides the data signals of the second polarity to source line S2 through switch SW2, switch SW2 is the second selection unit and source line S2 is the second source line. In this embodiment, the data of the first polarity is positive and the data of the second polarity is negative.

First, processor 3325 sequentially asserts control signals C1 and C3 for sequentially turning on switches SW1 and SW3. Therefore, source lines S1 and S3 receive the data of the first polarity output from data driver 3321 through switches SW1 and SW3. Next, processor 3325 asserts control signal C2 for turning on switch SW2. Therefore source line S2 receives the data of the second polarity output from data driver 3321 through switch SW2.

A column inversion driving method to display images also can be used, an embodiment of which will now be described with respect to FIG. 3*b*. In this regard, FIG. 3*b* is a timing diagram of the control module. With reference to FIG. 3*a*, during period $P_1$, gate driver 333 asserts gate line G1. During period $P_{11}$, processor 3325 asserts control signal C1 to turn on switch SW1. Data driver 3321 provides positive data signal D1 to source line S1.

During period $P_{12}$, processor 3325 asserts control signal C3 to turn on switch SW3. Data driver 3321 provides positive data signal D1 to source line S3.

During period $P_{13}$, processor 3325 asserts control signal C2 to turn on switch SW2. Data driver 3321 provides negative data signal D1 to source line S2.

Next, during period $P_2$, gate driver 333 asserts gate line G2. During period $P_{21}$, processor 3325 asserts control signal C1 to turn on switch SW1. Data driver 3321 provides negative data signal D1 to source line S1.

During period $P_{22}$, processor 3325 asserts control signal C3 to turn on switch SW3. Data driver 3321 provides negative data signal D1 to source line S3.

During period $P_{23}$, processor 3325 asserts control signal C2 to turn on switch SW2. Data driver 3321 provides positive data signal D1 to source line S2.

Data driver 3321 provides positive data signal D1 during periods $P_{11}$, $P_{12}$ and provides negative data signal D1 during periods $P_{13}$, $P_{21}$. The polarity of the data signal is only changed once, i.e. changed during period $P_{E1}$ comprising periods $P_{11}$, $P_{12}$, $P_{13}$, and $P_{21}$. Assuming the resolution of the display panel is 240×3×320 and a frame frequency is 60 Hz, a switch frequency of data driver 3321 is 19.2 KHz (60 Hz×320×1). Thus, the switch frequency of data driver 3321 has been reduced by two-thirds as compared with data driver 21. Therefore, power waste is reduced.

FIG. 3*c* is another timing diagram that can be used by a control module, such as the control module of FIG. 3*c*. FIG. 3*c* is similar to FIG. 3*b* except that timing of data signal during period $P_4$ differs from the timing of the data signal during period $P_2$.

During period $P_4$, gate driver 333 asserts gate line G2. During period $P_{41}$, processor 3325 asserts control signal C2 to turn on switch SW2. Data driver 3321 provides positive data signal to source line S2.

During period $P_{42}$, processor 3325 asserts control signal C1 to turn on switch SW1. Data driver 3321 provides negative data signal to source line S1.

During period $P_{43}$, processor 3325 asserts control signal C3 to turn on switch SW3. Data driver 3321 provides negative data signal to source line S3.

Data driver 3321 provides positive data signal D1 during periods $P_{31}$, $P_{32}$, provides negative data signal D1 during periods $P_{33}$, and provides positive data signal D1 during periods $P_{41}$. The polarity of the data signal changes twice, i.e., the polarity changes during period $P_{E2}$ comprising periods $P_{31}$, $P_{32}$, $P_{33}$, and $P_{41}$. Assuming the resolution of the display panel is 240×3×320 and a frame frequency is 60 Hz, a switch frequency of data driver 3321 is 38.4 KHz (60 Hz×320×2). This switch frequency of data driver 3321 has been reduced by one third as compared with data driver 21.

Figure 4A:
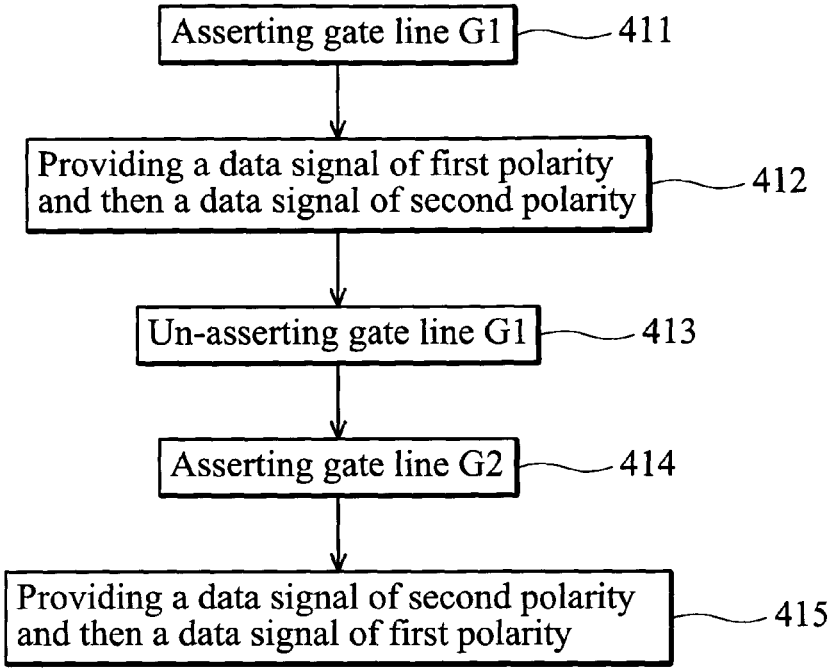
FIG. 4*a* is a flowchart of an embodiment of a control method.

FIG. 4*a* is a flowchart of an embodiment of a control method. With reference to FIGS. 3*a* and 3*b*, gate line G1 is asserted in step 411. Next, a data signal of first polarity is provided and then a data signal of second polarity is provided in step 412. For example, as shown in FIG. 3*a*, data driver 3321 sequentially provides positive data signal to source lines S1 and S3 through switches SW1 and SW3 and then provides negative data signal to source line S2 through switch SW2.

Gate line G1 is un-asserted in step 413 and gate line G2 is asserted in step 414. Next, a data signal of the second polarity is provided and then a data signal of the first polarity is provided in step 415. For example, as shown in FIG. 3*a*, data driver 3321 sequentially provides negative data signal to source lines S1 and S3 through switches SW1 and SW3 and then provides positive data signal to source line S2 through switch SW2.

Figure 4B:
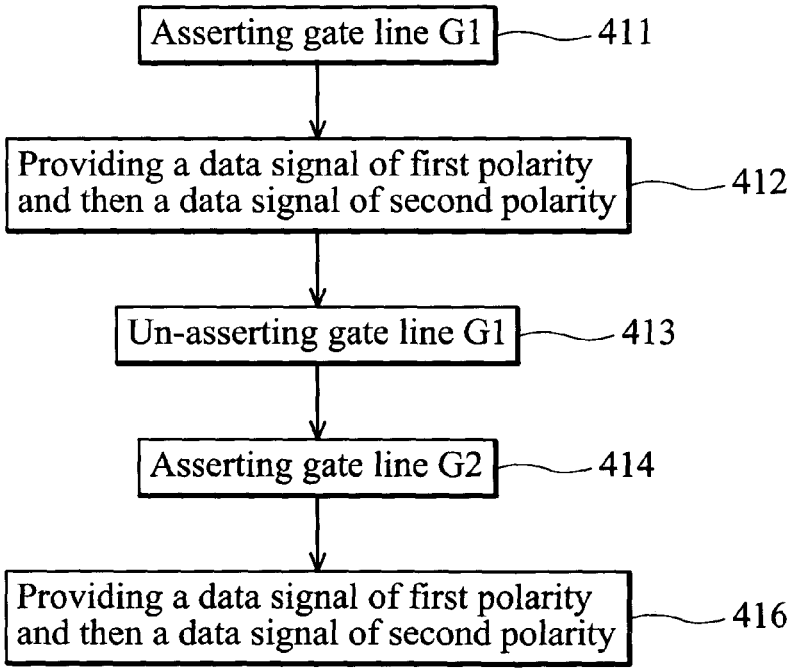
FIG. 4*b* is a flowchart of another embodiment of a control method.

FIG. 4*b* is a flowchart of another embodiment of a control method. FIG. 4*b* is similar to FIG. 4*a* except that step 416 differs from step 415. After gate line G2 is asserted in step 414, a data signal of the first polarity is provided and a data signal of the second polarity is then provided in step 416. For example, as shown in FIG. 3*a*, data driver 3321 provides positive data signal to source line S2 through switch SW2 and then sequentially provides negative data signal to source lines S1 and S3 through switches SW1 and SW3.

Figure 5:
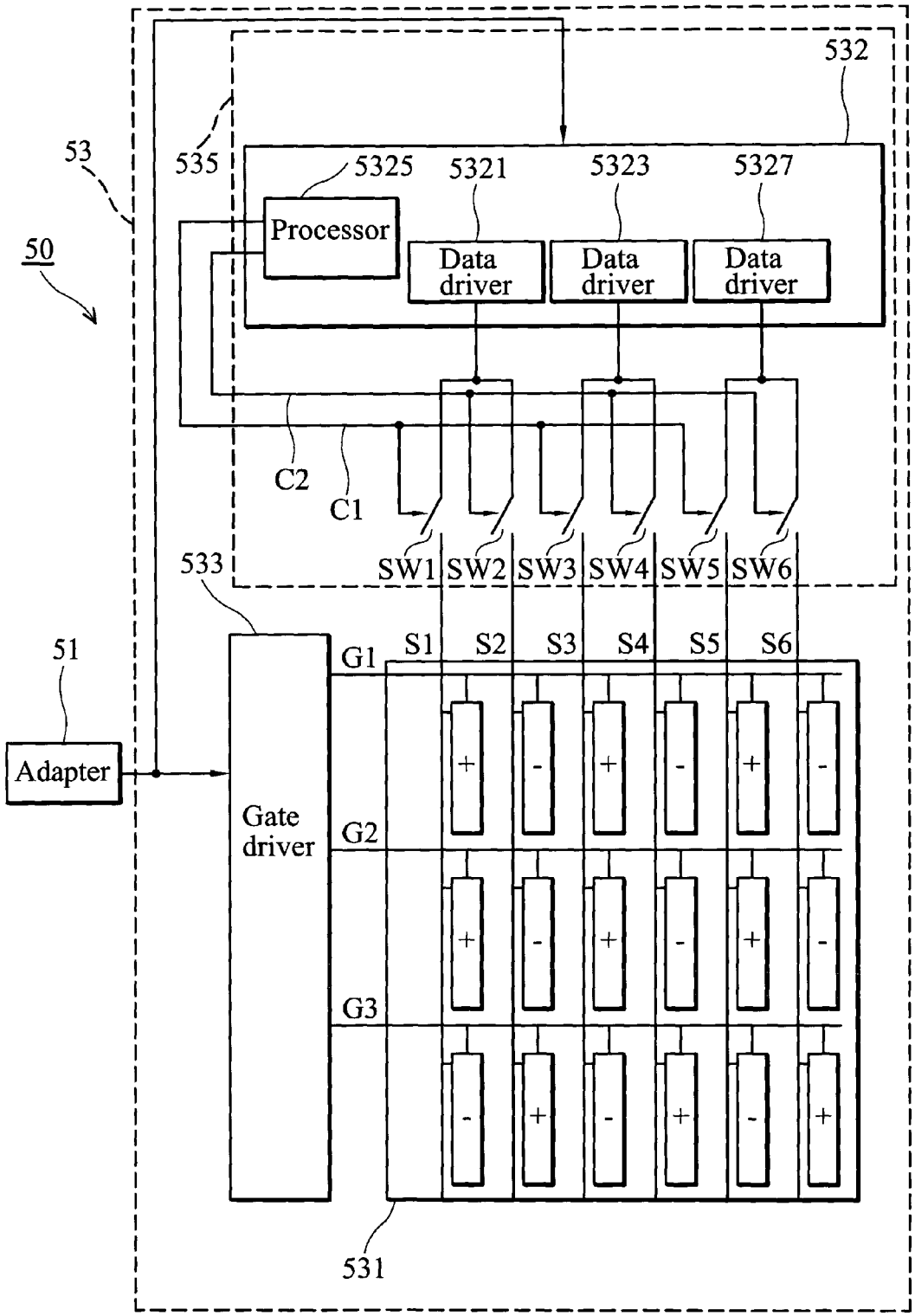
FIG. 5 is a schematic diagram of another exemplary embodiment of a system for displaying images.

FIG. 5 is a schematic diagram of another exemplary embodiment of a system for displaying images. As shown in FIG. 5, this system incorporates an electronic device 50 that comprises an adapter 51 and a display device 53. Adapter 51, such as DC to DC converter, provides a driving voltage to the display device 53. Display device 53 utilizes a two dot inversion driving method to display images and comprises a display module 531, a gate driver 533, and a control module 535.

FIG. 5 is similar to FIG. 3*a* except that processing unit 532 differs from processing unit 332. Processing unit 532 provides a data signal of a first polarity or a data signal of a second polarity to a first selection unit or a second selection unit.

Each of the data drivers 3321 and 3323 within processing unit 332 can control at least three selection units. Each of the data drivers 5321, 5323, and 5327 within processing unit 532 only controls two selection units. Operations of data drivers 5321, 5323, and 5327 are the same, data driver 5321 is given as an example. Note that in this embodiment, the data signal of the first polarity is positive and the data signal of the second polarity is negative.

When gate line G1 is asserted by gate driver 533, processor 5325 asserts control signal C1 to turn on switch SW1. Therefore, source line S1 receives the data signal of first polarity output from data driver 5321 through switch SW1.

Next, control signal C2 is asserted by processor 5325 such that switch SW2 is turned on. Therefore, source line S2 receives the data signal of second polarity output from data driver 5321 through switch SW2.

Gate line G1 is un-asserted and gate line G2 is asserted by gate driver 533. Processor 5325 asserts control signal C2 to turn on switch SW2. Therefore, source line S2 receives the data signal of second polarity output from data driver 5321 through switch SW2.

Next, control signal C1 is asserted by processor 5325 such that switch SW1 is turned on. Therefore, source line S1 receives the data signal of first polarity output from data driver 5321 through switch SW1.

Figure 6:
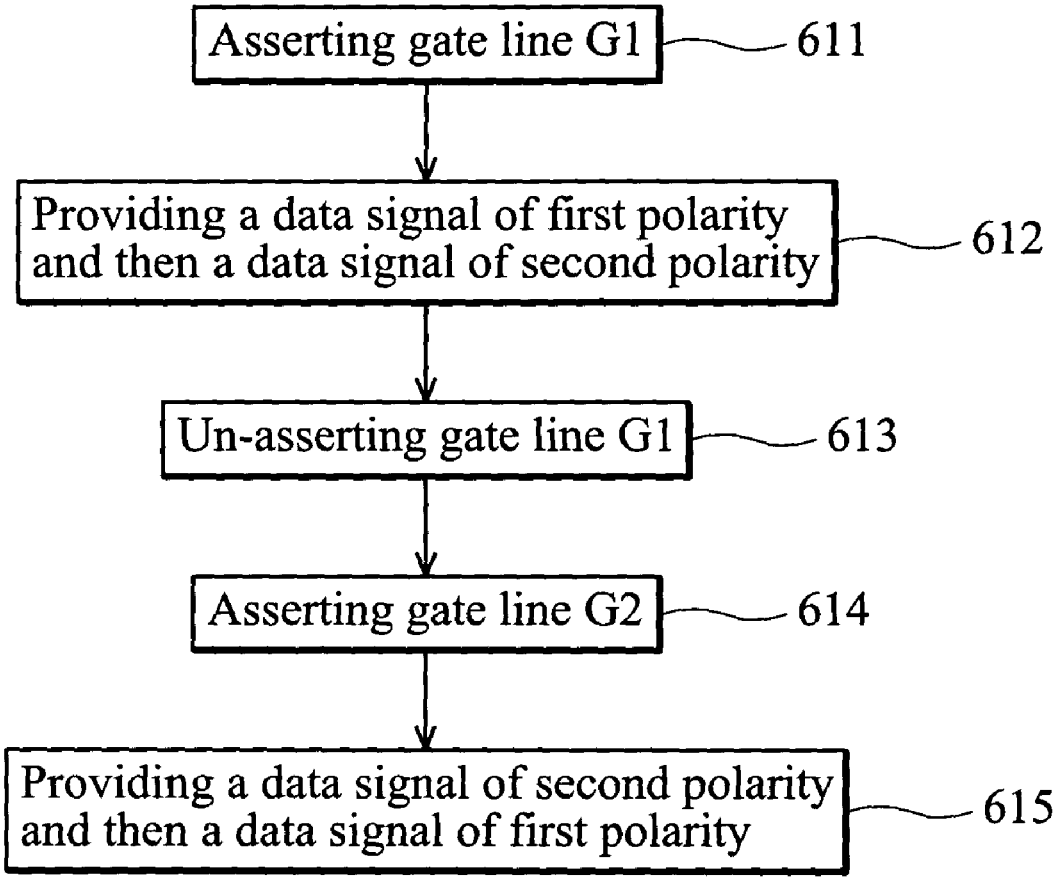
FIG. 6 is a flowchart depicting functionality of the control module shown in FIG. 5.

FIG. 6 is a flowchart depicting functionality of the control module shown in FIG. 5. As shown in FIG. 6, gate line G1 is asserted in step 611. Next, a data signal of the first polarity is provided and then a data signal of the second polarity is provided in step 612. For example, as shown in FIG. 5, data driver 5321 provides a positive data signal to source line S1 and then provides a negative data signal to source line S2.

Gate line G1 is un-asserted in step 613. Gate line G2 is asserted in step 614. A data signal of the second polarity is provided and then a data signal of the first polarity is provided in step 615. For example, as shown in FIG. 5, data driver 5321 provides a negative data signal to source line S2 and then provides a positive data signal to source line S1.

While the invention has been described by way of example and in terms of preferred embodiments, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A control method for a display panel which includes among other features comprising a first source line, a second source line, and a third source line, respectively; a first gate line and a second gate line, said method comprising: asserting the first gate line; providing a first data signal of a first polarity from a first data driver and activating a first switch to transmit the first data signal to the first source line when the first gate line is assert; providing a second data signal of the first polarity from the first data driver and activating a second switch to transmit the second data signal to the third source line after the first data signal is provided to the first source line; and providing a third data signal of a second polarity from the first data driver and activating a third switch to transmit the third data signal to the second source line after the second data signal is provided to the third source line, wherein the first, the second, and the third source lines are sequentially disposed, and wherein the first, the third and the second switches are sequentially activated.

2. The control method as claimed in claim 1, further comprising:

un-asserting the first gate line after the second source line receives the third data signal of the second polarity;

asserting the second gate line;

providing a fourth data signal of the first polarity to the first source line;

providing a fifth data signal of the first polarity to the third source line after the fourth data signal is provided to the first source line; and providing a sixth data signal of the second polarity to the second source line after the fifth data signal is provided to the third source line.

3. The control method as claimed in claim 1, further comprising:

un-asserting the first gate line after the second source line receives the third data signal of the second polarity;

asserting the second gate line;

providing a fourth data signal of the second polarity to the first source line;

providing a fifth data signal of the second polarity to the third source line after the fourth data signal is provided to the first source line; and providing a sixth data signal of the first polarity to the second source line after the fifth data signal is provided to the third source line.

4. The control method as claimed in claim 1, further comprising:

un-asserting the first gate line after the second source line receives the third data signal of the second polarity;

asserting the second gate line;

providing a fourth data signal of the second polarity to the second source line;

providing a fifth data signal of the first polarity to the first source line after the fourth data signal is provided to the second source line; and providing a sixth data signal of the first polarity to the third source line after the fifth data signal is provided to the first source line.

5. The control method as claimed in claim 1, further comprising:

un-asserting the first gate line after the second source line receives the third data signal of the second polarity;

asserting the second gate line;

providing a fourth data signal of the first polarity to the second source line;

providing a fifth data signal of the second polarity to the first source line after the fourth data signal is provided to the second source line; and providing a sixth data signal of the second polarity to the third source line after the fifth data signal is provided to the first source line.

6. A system for displaying images comprising:

a display panel comprising:

a first data driver, a first source line, a second source line, a third source line, a first gate line and a second gate line;

wherein the display panel further comprises: a first switch connected between the first data driver and the first source line, a second switch connected between the first data driver and the second source line and a third switch connected between the first data driver and the third source line, and wherein after the first gate line is asserted, the first switch is activated and the first data driver provides a first data signal of a first polarity to the first source line via the first switch, after the first data signal is provided to the first source line, the third switch is activated and the first data driver provides a second data signal of the first polarity to the third source line via the third switch, after the second data signal is provided to the third source line, the second switch is activated and the first data driver provides a third data signal of a second polarity to the second source line via the second switch;

wherein the first, the second, and the third source lines are sequentially disposed, and wherein the first, the third and the second are sequentially activated.

7. A system for displaying images comprising: a display panel comprising: a first source line, a second source line, and a third source line, respectively; a first data driver, a first gate line and a second gate line; wherein the display panel further comprises: a first switch connected between the first data driver and the first source line, a second switch connected between the first data driver and the second source line and a third switch connected between the first data driver and the third source line, and wherein after the first gate line is asserted, the first switch is activated and the first data driver provides a first data signal of a first polarity to the first source line via the first switch, after the first data signal is provided to the first source line, the third switch is activated and the first data driver provides a second data signal of the first polarity to the third source line via the third switch, after the second data signal is provided to the third source line, the second switch is activated and the first data driver provides a third data signal of a second polarity to the second source line via the second switch; wherein the first, the second, and the third source lines are sequentially disposed, and wherein the first, the third and the second switches are sequentially activated.

8. The system as claimed in claim 6, wherein the first data signal of the first polarity is a negative video signal and the third data signal of the second polarity is a positive video signal.

9. The system as claimed in claim 8, wherein first data driver has a first selection unit providing the first data signal to the first source line or providing the second data signal to the third source line, and a second selection unit providing the third data signal to the second source line.

10. The system as claimed in claim 9, wherein the display module and the first data driver are incorporated into an electronic device.

11. The system as claimed in claim 10, wherein the electronic device is a PDA, a notebook computer, a tablet computer, or a cellular phone.

12. The system as claimed in claim 9, further comprising an adapter operative to provide a driving voltage for driving the display module.

13. The system as claimed in claim 9, further comprising means for providing a driving voltage to drive the display module.

14. The system as claimed in claim 6, wherein after the first data driver provides the third data signal of the second polarity to the second source line, the first gate line is un-asserted and the second gate line is asserted.

15. The system as claimed in claim 14, wherein after the second gate line is asserted, the first data driver provides a fourth data signal of the first polarity to the first source line, after the fourth data signal of the first polarity is provided to the first source line, the first data driver provides a fifth data signal of the first polarity to the third source line, and after the fifth data signal is provided to the third source line, the first data driver provides a sixth data signal of the second polarity to the second source line.

16. The system as claimed in claim 14, wherein after the second gate line is asserted, the first data driver provides a fourth data signal of the second polarity to the first source line, after the fourth data signal is provided to the first source line, the first data driver provides a fifth data signal of the second polarity to the third source line, and after the fifth data signal is provided to the third source line, the first data driver provides a sixth data signal of the first polarity to the second source line.

17. The system as claimed in claim 14, wherein after the second gate line is asserted, the first data driver provides a fourth data signal of the second polarity to the second source line, after the fourth data signal is provided to the second source line, the first data driver provides a fifth data signal of the first polarity to the first source line, and after the fifth data signal is provided to the first source line, the first data driver provides a sixth data signal of the first polarity to the third source line.

18. The system as claimed in claim 14, wherein after the second gate line is asserted, the first data driver provides a fourth data signal of the first polarity to the second source line, after the fourth data signal is provided to the second source line, the first data driver provides a fifth data signal of the second polarity to the first source line, and after the fifth data signal is provided to the first source line, the first data driver provides a sixth data signal of the second polarity to the third source line.

* * * * *

UNITED STATES PATENT AND TRADEMARK OFFICE

CERTIFICATE OF CORRECTION

PATENT NO. : 7,834,868 B2
APPLICATION NO. : 11/344931
DATED : November 16, 2010
INVENTOR(S) : Lee It is certified that error appears in the above-identified patent and that said Letters Patent is hereby corrected as shown below:

Col. 6, lines 37-38, the phrase "which includes among other features" should be deleted.

Col. 7, lines 40-64, the entirety of claim 6 should be deleted.

Col. 7, line 65: Claim number 7 should be renumbered as claim number 6.

Col. 8, at line 19 (just before claim 8), insert the following: --7. The system as claimed in claim 6, wherein the first data signal of the first polarity is a positive video signal and the third data signal of the second polarity is a negative video signal.--

Signed and Sealed this
Second Day of August, 2011

David J. Kappos

David J. Kappos
*Director of the United States Patent and Trademark Office*